United States Patent [19]

Malacheski et al.

[11] 4,193,165

[45] Mar. 18, 1980

[54] HINGE CONSTRUCTION

[76] Inventors: Joseph J. Malacheski; Richard J. Zenda, both of 32 Warner St., Plains, Pa. 18705

[21] Appl. No.: 950,366

[22] Filed: Oct. 11, 1978

[51] Int. Cl.[2] ..... E05D 11/06

[52] U.S. Cl. ..... 16/191

[58] Field of Search ..... 16/54, 50, 82, 85, 86 R, 16/137, 139, 140, 142, 143, 191

[56] References Cited

U.S. PATENT DOCUMENTS

| | | | |
|---|---|---|---|
| 2,553,882 | 5/1951 | Sweet | 16/142 |
| 2,803,850 | 8/1957 | Hooper | 16/191 X |
| 2,930,075 | 3/1960 | Deutchman et al. | 16/191 |
| 3,391,420 | 7/1968 | Anderson | 16/180 X R |
| 3,623,185 | 11/1971 | Cartwright, et al. | 16/180 X |
| 3,629,899 | 12/1971 | Deadrick | 16/142 |
| 3,972,090 | 8/1976 | Holmes | 16/139 |

*Primary Examiner*—George H. Krizmanich

[57] ABSTRACT

A hinge construction composed of two cooperating leaves provided with a deflectable resilient retention means to retain sashes, particularly basement windows and various other similar devices installed to swing open from the bottom or vertically, in a predetermined open position, whereby maintaining a sash in an open position until an overriding force is applied thereto intended to effect its closure, the retention means having a retention groove and a stop limiting range of hinge movement.

10 Claims, 4 Drawing Figures

HINGE CONSTRUCTION

BACKGROUND OF THE INVENTION

While the field of hinges is highly developed, and while, more specifically, a wide variety of hinges have been designed to retain sashes and other similar devices that open from the bottom or vertically, such as basement windows, these hinges, while serving the intended purpose, are rather complex and therefore costly to manufacture, require in some instances, special installation and/or operation, and for these reasons have not found general acceptance.

SUMMARY OF THE INVENTION

It is, therefore, an important object of the present invention to provide a hinge construction substantially provided with a staunch and sturdy positive retention means which will hold a sash or similar device in a predetermined open position without the necessity of employing separate hooks, catches, and props.

It is a more particular object of the present invention to provide a hinge construction having the advantageous characteristics mentioned in the preceding paragraph which is also extremely simplistic in design and operation, which can be inexpensively mass-produced, and which can be readily and easily installed, and therefore admirably well-suited for its intended usage.

Other objects of the present invention will become apparent upon reading the following specification and referring to the accompanying drawings, which form a material part of this disclosure.

The invention accordingly consists in the features of construction, combination of elements, and arrangement of parts, which will be exemplified in the construction hereinafter described, and of which the scope will be indicated by the appended claims.

DESCRIPTION OF THE PREFERRED EMBODIMENT

Figure 3:
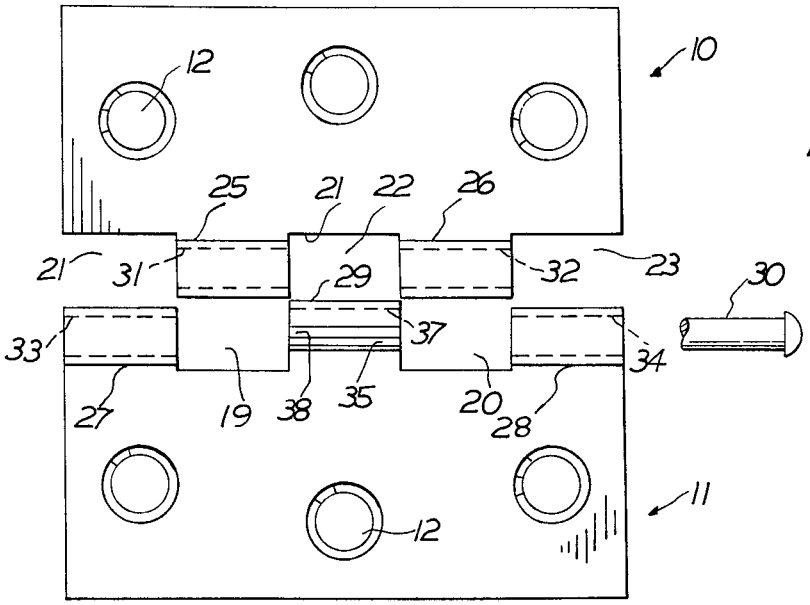
FIG. 3 is a top plan view of hinge leaves and abbreviated pin, unassembled to illustrate the notchlike configuration formed on one side margin of the leaves by the arrangement of hinge knuckles and alternate openings.

Referring now more particularly to the drawings and specifically to FIG. 3 thereof, a hinge leaf there generally designated 10 is provided with outwardly projecting tubular portions or knuckles 25 and 26. Said knuckles are provided with pin-receiving passages 31 and 32, respectively.

Similarly, a hinge leaf generally designated 11 is provided with outwardly projecting knuckles 27 and 28 which are provided with pin-receiving passages 33 and 34, respectively.

Hinge leaf 11 is further provided with a retention means generally designated 18. Said retention means is integral with side margin of said hinge leaf and will appear more fully hereinafter.

Figure 1:
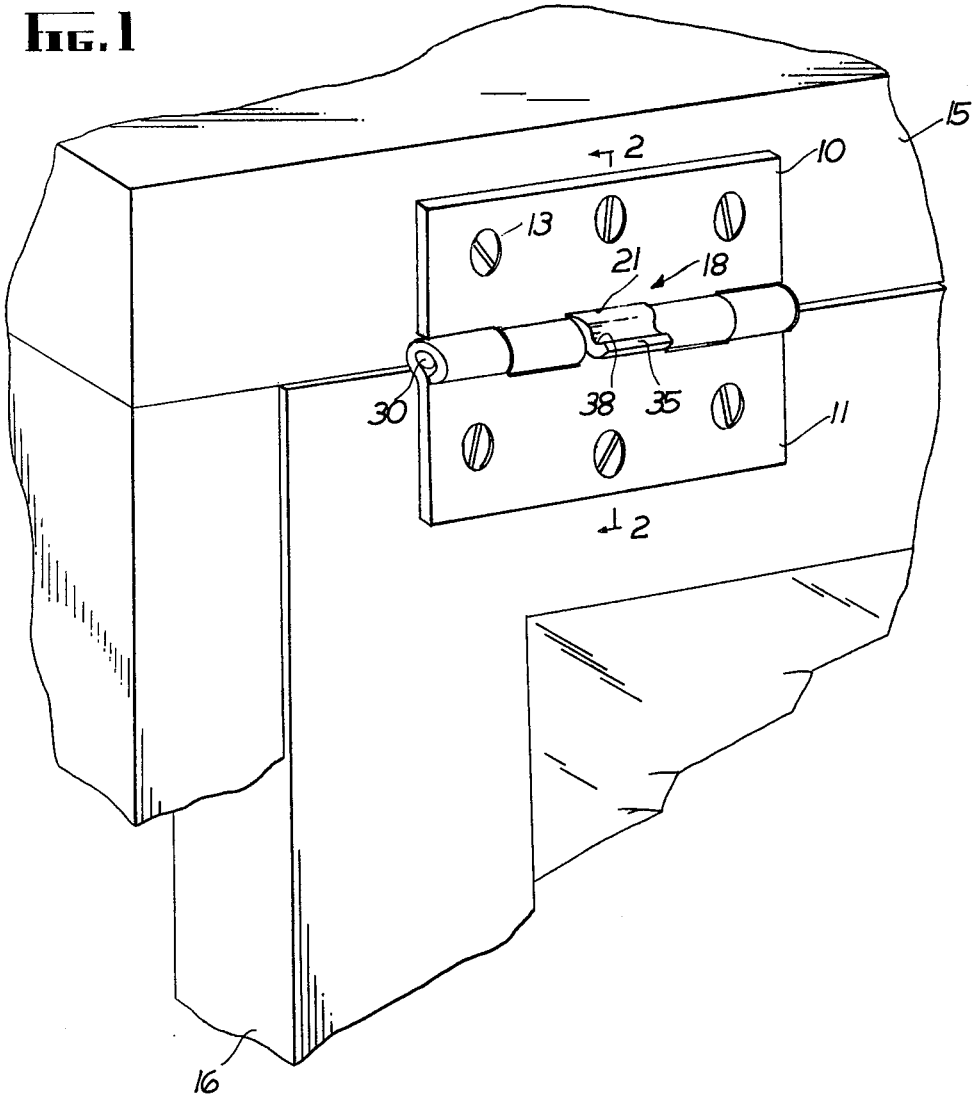
FIG. 1 is a partial perspective view, abbreviated to conserve drawing space, showing a hinge construction in accordance with the teachings of the present invention installed to a sash frame and cooperating sash.
Figure 2:
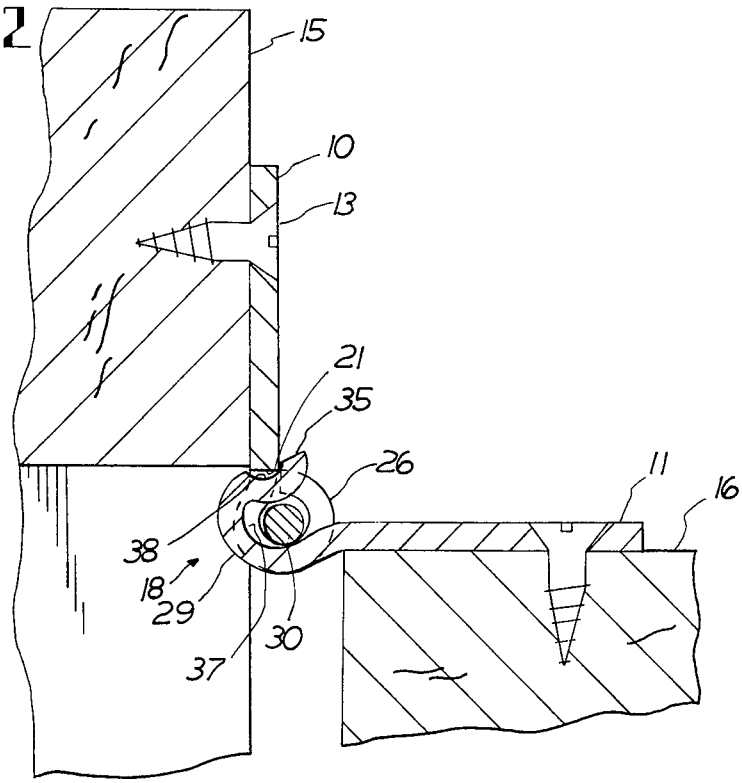
FIG. 2 is a partial sectional view, generally taken along line 2—2 of FIG. 1, showing the present invention in operative association with sash frame and cooperating sash.

Said hinge leaves are provided with screw apertures 12 to receive screws 13 by means of which hinge leaf 10 may be secured to the sash frame 15, which is in a relatively fixed position, and by means of which hinge leaf 11 may be secured to the sash 16, see FIGS. 1 and 2. It may be understood, of course, that, reversely, hinge leaf 10 may be secured to said sash while hinge leaf 11 may be secured to said sash frame.

To form a hinge composed of two cooperating leaves, knuckles 25–28 and retention means 18 are arranged alternately with openings 19–23 integrally along the entire length of one side margin of leaves 10 and 11, thereby forming notchlike configurations on said leaves, see FIG. 3. When said leaves are brought together into an interfitting relationship, that is, when knuckles 25–28 and retention means 18 enter openings 19, 20, 21, 23, and 22 respectively, pin-receiving passages 31–34 and the general pin-receiving passage area 37 align to form a continuous passageway for the reception of a pivotal pin 30 which pivotally interconnects said leaves, as best seen in FIG. 1.

As thus far described, the present embodiment is generally conventional.

Referring now more particularly to retention means 18 as shown in FIG. 1 and in detail in FIG. 2, said retention means essentially consists of a cliplike appendage or an arcuated member 29 integral with a side margin of leaf 11, said member 29 being deflective and resilient and having a radius increasingly greater than the curvature associated with the circumference of knuckles 25–28.

In view of member 29 being generally on line with knuckles 25–28 and said member being contiguous with deflector edge 21 and said member having an increasingly greater radius than the curvature of said knuckles, said member is accordingly afforded resilient deflection. That is, as member 29, being in resilient registration or contiguous with deflector edge 21, which is a side margin of opening 22, is pivotally forced against said edge, as during upward movement of hinge leaf 11, the said edge deflects member 29 to afford it an increasing resilient deflection while said member substantially refers an increasingly resilient force to said edge. Conversely, when movement of hinge leaf is downward, as during closure of sash, the member 29 is afforded a decreasingly resilient deflection by deflector edge 21 while said member refers a decreasing resilient force to said edge.

When the sash 16 reaches its predetermined open position, as shown in FIG. 2, a retention slot or furrow 38 formed into the member 29, preferably at right angles to the said member, will resiliently engage deflector edge 21 to thereby hold said sash in said position, the weight of said sash being insufficient to overpower the resilient force of the member 29.

It is to be understood that in lieu of the preferred slot or furrow 38 that an upstanding member, stamped-out projection, or the like could serve equally as well to engage deflector edge 21. It is further to be understood that more than one retention groove may be integrated into member 29 so as to provide an additional setting for a predetermined open position, such as for a partially open sash position serving limited ventilation.

A flange or terminal stub 35 at the distal end of member 29 will contact face of hinge leaf 10 to limit the range of upward movement of leaf 11 and accordingly act as a stop to prevent furrow 38 from overriding or disengaging edge 21. Thus hinge leaf 11 may pivot about pin 30; leaf 10 is fixed.

To close sash, a small downward force need only be thereto applied to overpower the resilient force of member 29 and thereby cause retention furrow 38 to pivotally disengage deflector edge 21. That is, said member is pivotally and resiliently forced against and thereby deflected by said edge, as during closure of sash, so that said groove will ride off or disengage said edge.

Figure 4:
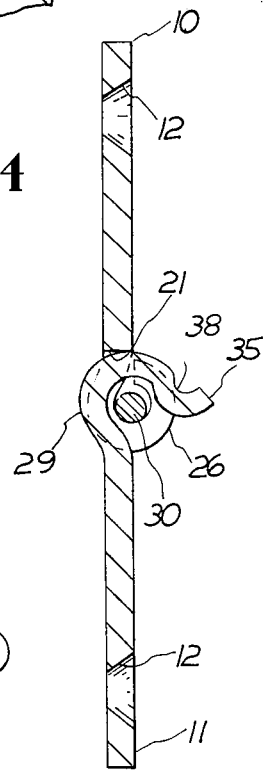
FIG. 4 is a sectional view, generally taken along line 2—2 of FIG. 1, showing the hinge leaf with the retention means in an unstressed condition.

If accidental disconnection occurs, the sash will be prevented from closing forcefully by reason of the reverse resilient decreasing force referred by member 29 to deflector edge 21 to thereby initially retard downward sash movement. FIG. 4 serves to illustrate the member 29 by showing it in an unstressed condition.

From the foregoing, it is seen that the present invention provides a hinge construction which is capable of supporting or retaining windows and similar devices in one or more open or predetermined positions and can be utilized in any situation where it is desirable to retain openable closures in open position any where it is determined that such use would be convenient and advantageous.

Although the present invention has been described in some detail by way of illustration and example for purposes of clarity of understanding, it is to be understood that certain changes and modifications may be made within the spirit of the invention.

What is claimed is:

1. A hinge construction composed of two cooperating hinge leaves provided with outwardly projecting knuckles with pin-receiving passages, said knuckles integral with and arranged alternately with openings along the entire length of one side margin of said leaves, at least one retention means integral with and projecting from at least one said leaf and comprised of an arcuated member which is in resilient registration with a deflector, said member having a radius increasingly greater than and outside of the circumference of said knuckles, said knuckles interfitting with said openings to align said passages and said retention means to receive a pivotal pin to pivotally interconnect said leaves, a retention furrow to resiliently engage and disengage said deflector comprised of a side margin of a said opening, and stop means to limit movement of a said leaf.

2. A hinge construction according to claim 1, said member being increasingly deflected by said deflector when said construction is in an operative condition of opening and decreasingly deflected by said deflector when said construction is in an operative condition of closing.

3. A hinge construction according to claim 2, said member and deflector being pivotally contiguous when said construction is in an operative condition.

4. A hinge construction according to claim 3, said member being deflective while maintaining a substantial resilient force.

5. A hinge construction according to claim 1, said member being generally on line with said knuckles to thereby place its curvature outside of the circumference of said knuckles and align its general pin-receiving passage area with said passages of said knuckles for reception of said pin.

6. A hinge construction according to claim 5, said member extending partially about said pin.

7. A hinge construction according to claim 1, said furrow being at right angles to said member.

8. A hinge construction according to claim 1, said stop comprised of a terminal stub at the distal end of said member to contact a said hinge leave to limit movement of movable hinge leaf and prevent said furrow from overriding said deflector.

9. A hinge construction according to claim 7, said terminal stub extending beyond the said curvature of said member.

10. A hinge construction according to claim 1, said member, said furrow, and said stub being an integrated unit.

* * * * *